US008826712B1

(12) United States Patent
Luckey, Jr. et al.

(10) Patent No.: US 8,826,712 B1
(45) Date of Patent: Sep. 9, 2014

(54) PRESSURE SEQUENCE PROCESS FOR HYDRO-FORMING AN EXTRUDED STRUCTURAL TUBE

(71) Applicant: Ford Global Technologies, LLC, Dearborn, MI (US)

(72) Inventors: S. George Luckey, Jr., Dearborn, MI (US); Kiran Kumar Mallela, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/836,822

(22) Filed: Mar. 15, 2013

(51) Int. Cl.
*B21D 9/15* (2006.01)
*B21D 26/02* (2011.01)
*B21D 26/033* (2011.01)

(52) U.S. Cl.
CPC ..... *B21D 26/033* (2013.01)
USPC ..... 72/58; 72/57; 72/61; 29/421.1

(58) Field of Classification Search
USPC ..... 72/55, 57, 58, 60, 61, 62, 367, 370.22; 29/421.1
See application file for complete search history.

(56) References Cited

U.S. PATENT DOCUMENTS

| | | | | |
|---|---|---|---|---|
| 3,750,904 | A | 8/1973 | Wisler | |
| 5,070,717 | A * | 12/1991 | Boyd et al. | 72/55 |
| RE33,990 | E * | 7/1992 | Cudini | 72/370.22 |
| 5,339,667 | A * | 8/1994 | Shah et al. | 72/58 |
| 5,728,241 | A | 3/1998 | Gupta et al. | |
| 5,890,387 | A * | 4/1999 | Roper et al. | 72/58 |
| 6,257,035 | B1 | 7/2001 | Marks et al. | |
| 6,415,638 | B1 | 7/2002 | Sakurai et al. | |
| 6,739,166 | B1 * | 5/2004 | Shah | 72/57 |
| 7,491,278 | B2 | 2/2009 | Kropfl | |
| 8,171,769 | B2 * | 5/2012 | Barthelemy et al. | 72/370.22 |
| 8,297,096 | B2 * | 10/2012 | Mizumura et al. | 72/57 |
| 2010/0206035 | A1 | 8/2010 | Bestard et al. | |

FOREIGN PATENT DOCUMENTS

WO 2008059242 5/2008

* cited by examiner

*Primary Examiner* — David B Jones
(74) *Attorney, Agent, or Firm* — Raymond L. Coppiellie; Brooks Kushman P.C.

(57) ABSTRACT

A pressure sequence hydro-forming method is used to form an extruded structural tube. The extruded structural tube is placed in a hydro-forming die that is partially closed to compress the tube. The tube is filled with a hydro-forming liquid at a first pressure. The hydro-forming die is then closed and the pressure of the hydroforming fluid is increased as the hydro-forming die is fully closed. The pressure is increased to a second level of pressure to shape the tube into the desired part shape.

14 Claims, 3 Drawing Sheets

PRESSURE SEQUENCE PROCESS FOR HYDRO-FORMING AN EXTRUDED STRUCTURAL TUBE

TECHNICAL FIELD

Extruded structural tubes are extruded through a die, cut to size and formed in a hydro-forming process.

BACKGROUND

Vehicle manufacturers are implementing lighter, stronger materials, such as aluminum alloys to meet emission reduction goals, meet fuel economy goals, reduce manufacturing costs, and reduce vehicle weight. Increasingly demanding safety standards must be met while reducing vehicle weight. One approach to meeting these competing interests and objectives is to hydro-form high strength aluminum alloy tubular blanks into strong, lightweight hydro-formed parts.

Aluminum tube types include seam-welded tube, extruded seamless tube, and extruded structural tube. Seam-welded tube and extruded seamless tube are expensive. Seam-welded tubes and extruded seamless tubes are expensive to convert to finished hydro-formed parts. Extruded structural tubes are lower in cost because they are formed in a continuous mill operation having a greater line and material utilization efficiency than extruded seamless tubes and seam-welded tubes.

Extruded structural tubes are formed by extruding an aluminum billet through an extrusion die at a high temperature and at high pressure. Discontinuous material flow across the section of the shape occurs when the flowing aluminum separates in the mandrel plate and re-converges in the cap section. A weld line, or joining line, is created where the flowing aluminum re-converges to form the extruded shape. Extruded structural tubes may have two or more weld lines that are an artifact of the porthole extrusion process.

Hydro-forming complex parts may require a series of bending, pre-forming, hydro-forming, piercing and machining operations. Bending and hydro-forming aluminum tubes is not currently in use in high volume production operations. (ie. more than 100,000 units/year) Aluminum intensive vehicles (AIVs) are envisioned that use metal forming methods consistent with current conventional automotive manufacturing methods.

In a high pressure hydro-forming (HPH) operation, the tube is inserted in the HPH die before any fluid under pressure is provided inside the tube. The dies are closed that can result in buckling the tube's cross-section. High pressure incompressible hydro-forming fluid, such as water, is supplied to expand and shape the tube to conform to the die cavity. Substantial press tonnage is required to hydro-form parts in HPH processes. Substantial expansion of the tube (circumferential length of line expansion of more than 5%) is necessary to eliminate any tube buckles and produce complexly shaped parts. It is not feasible to form most parts from aluminum tubes with high expansion HPH operations because aluminum seam-welded, seamless tubes and structural extrusion tubes are less formable than mild steel tubes.

The above challenges and other challenges are addressed by this disclosure as summarized below.

SUMMARY

According to one aspect of this disclosure, a method is disclosed for forming an extruded structural tube to form a part. The extruded structural tube is first loaded into a hydro-forming die. The hydro-forming die is partially closed and the extruded structural tube is filled with a liquid beginning at a first pressure. The hydro-forming die is then closed with the tube disposed in the hydro-forming die. The level of pressure applied to the liquid is increased to a second level of pressure to shape the extruded structural tube to form the part.

The extruded structural tube may be pre-bent along its length in a rotary draw bending operation or a push roll bending operation and may be pre-formed radially in a pre-forming die. The pre-bending and pre-forming steps precede loading the pre-bent/pre-formed tube into the hydro-forming die. The hydro-forming die cavity has a shape with a circumferential perimeter that is less than or equal to 2% greater than the circumferential perimeter of the extruded structural tube.

According to a further aspect of this disclosure, a method of forming a part comprises extruding an aluminum alloy through a porthole die to form an extruded structural tube. The tube is cut to the desired size and is bent to form a pre-bent tube. The pre-bent tube may be bent in either a rotary draw bending operation or in a push roll bending operation. (As used herein, the term "bending operation" should be understood and interpreted as referring to in either a rotary draw bending operation or in a push roll bending operation.) The pre-bent and pre-formed tube is loaded into a hydro-forming die that is partially closed to radially compress the pre-bent and pre-formed tube. The pre-bent and pre-formed tube is placed in a hydro-forming die and filled with a liquid at a first level of pressure. The hydro-forming die is closed completely and the level of pressure applied to the liquid is increased to a second level of pressure that is greater than the first level of pressure to shape the pre-bent and pre-formed tube into the part.

According to another aspect of this disclosure, a method of forming a part from an extruded structural tube is disclosed that begins with extruding an aluminum alloy to form the extruded structural tube. The tube is pre-bent in a bending operation to form a pre-bent tube. The pre-bent tube is then loaded into a pre-forming die and the pre-forming die radially compresses the tube to form a pre-bent/pre-formed tube. The pre-bent/pre-formed tube is filled with a liquid at a first level of pressure as the hydro-forming die is partially closed. The hydro-forming die is then fully closed against the pre-bent/pre-formed tube and the level of pressure of the liquid is increased to a second level of pressure to shape the tube.

According to other aspects of this disclosure that may be combined with any of the above described methods, the extruding step may further comprise extruding aluminum at a billet temperature greater than 450° C. and less than 600° C. through an extrusion die including a mandrel plate that separates the heated aluminum and a cap section that re-converges the heated aluminum to form the extruded structural tube with a plurality of weld lines being formed where the heated aluminum re-converges. The extrusion die may be a porthole die which may also be referred to as an extruded structural tube die.

According to another aspect of this disclosure that may be combined with any of the above described methods, the step of pre-bending the extruded structural tube is a bending operation that may be performed in a rotary draw bending tool or a push-roll bending tool.

According to other aspects of this disclosure that may be combined with any of the above described methods, the step of increasing the level of pressure may further comprise increasing the level of pressure beginning with the step of filling the tube and wherein the level of pressure is gradually increased to the second level. The first level of pressure may be referred to as a closing pressure and the second level of pressure may be referred to as a calibration pressure. The step of increasing the level of pressure within the tube in the hydro-forming die results in the tube being hydro-formed into the die. The step of increasing the level of pressure within the tube in the hydro-forming die may further comprise hydro-piercing the tube.

The above aspects of this disclosure and other aspects will be described in greater detail below with reference to the attached drawings.

DETAILED DESCRIPTION

A detailed description of the illustrated embodiments of the present invention is provided below. The disclosed embodiments are examples of the invention that may be embodied in various and alternative forms. The figures are not necessarily to scale. Some features may be exaggerated or minimized to show details of particular components. The specific structural and functional details disclosed in this application are not to be interpreted as limiting, but merely as a representative basis for teaching one skilled in the art how to practice the invention.

Figure 1:
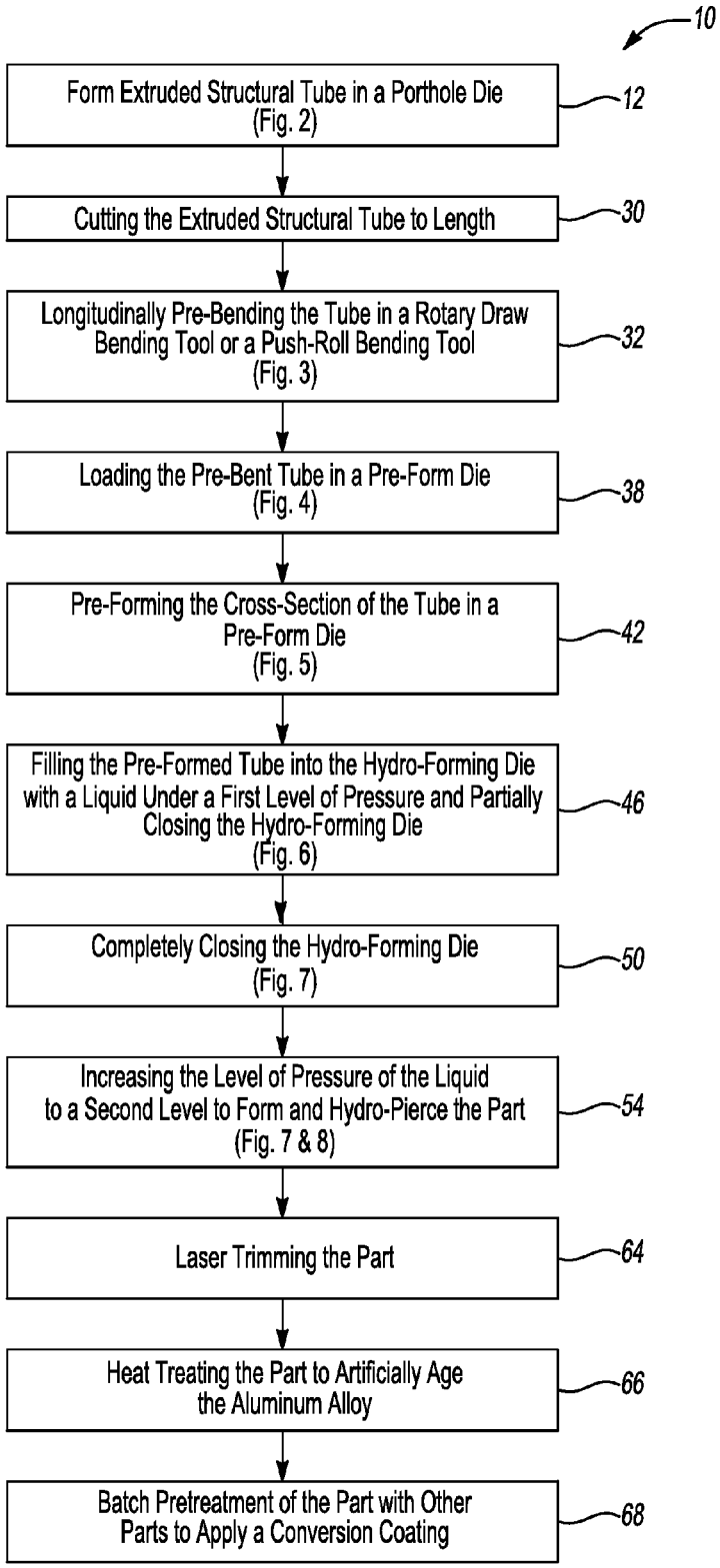
FIG. 1 is a flowchart illustrating one example of a pressure sequence hydro-forming process for extruding a structural tube.
Figure 2:
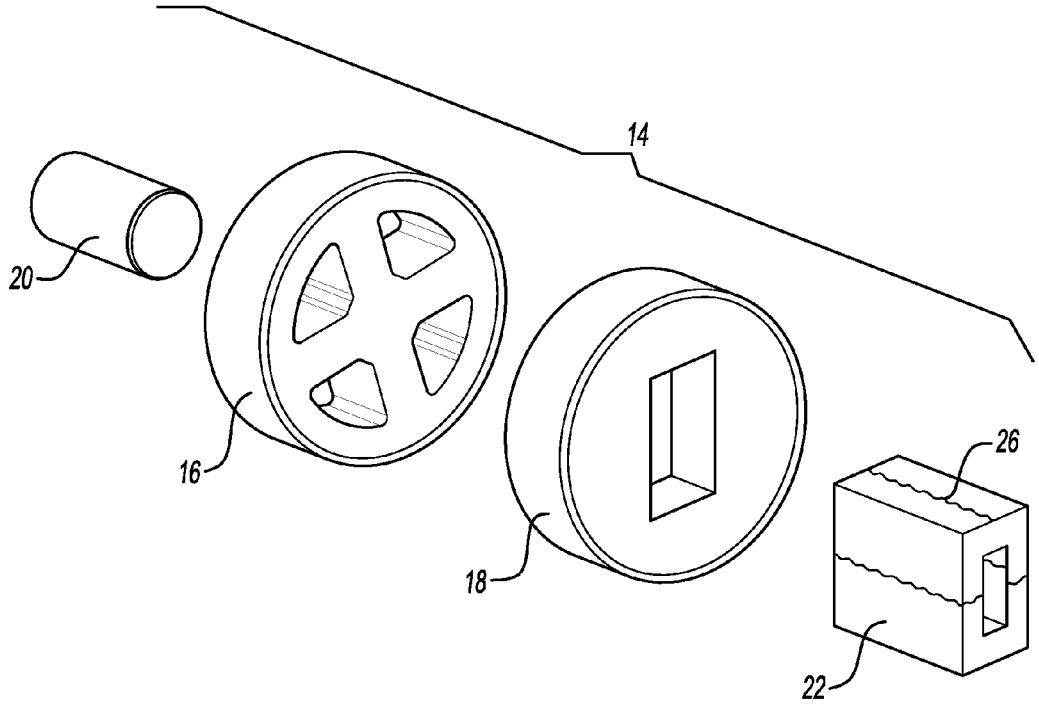
FIG. 2 is an exploded perspective view of a porthole die.

Referring to FIGS. 1 and 2, one example of a process for hydro-forming an extruded structural tube is illustrated. The process begins by forming an extruded structural tube in a porthole die at 12. Referring to FIG. 2, one example of a porthole extrusion die 14 is illustrated. The porthole extrusion die 14 includes a mandrel plate 16 and a cap section 18. An aluminum billet 20 is heated and extruded through the porthole extrusion die 14. The aluminum billet 20 is extruded at high temperature and pressure through the extrusion die 14. The extruded aluminum is separated in the mandrel plate 16 and re-converges in the cap section 18. The point that the aluminum re-converges creates weld lines 26 in the extruded tube 22. The extruded tube 22 may be referred to as a structural extruded tube. The extruded tube 22 is formed in a continuous mill operation.

Figure 3:
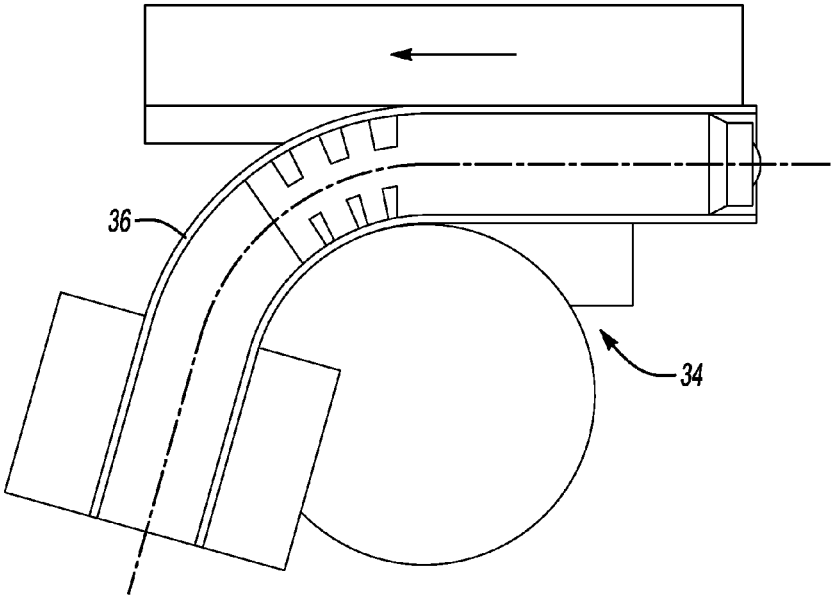
FIG. 3 is a diagrammatic representation of a rotary draw bending tool pre-forming a portion of a tube.

Referring to FIGS. 1 and 3, the extruded, or structural, tube 22 is cut to length at 30. As shown in FIG. 3, the tube is then pre-formed at 32 in a rotary draw bending tool 34.

Figure 4:
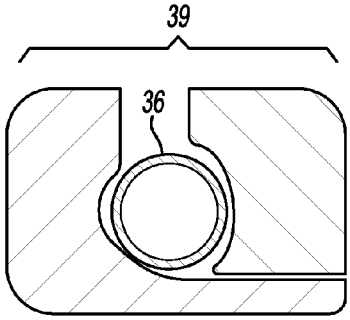
FIG. 4 is a diagrammatic cross-sectional view of a pre-formed tube in a pre-forming die.

Referring to FIGS. 1 and 4, the pre-formed tube 36 is loaded at 38 into a pre-form die 39. As shown in FIG. 4, the pre-formed tube 36 is loaded into the pre-form die 39 that is illustrated as a two-part die 39, but could be a die having more than two parts.

Figure 5:
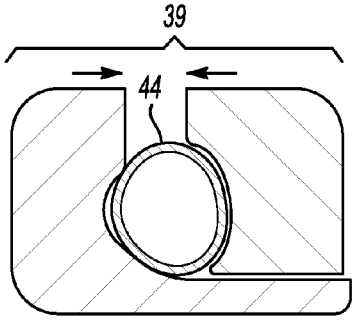
FIG. 5 is a diagrammatic cross-sectional view of the pre-forming die radially compressing the pre-bent/pre-formed tube.

Referring to FIGS. 1 and 5, the next step in the process is to partially close the pre-form die 39 to radially compress the pre-formed tube at 42. Referring specifically to FIG. 5, the pre-formed tube 36 (shown in FIG. 4) is illustrated as it is compressed in the pre-form die 39 to form a pre-bent/pre-formed tube 44.

Figure 6:
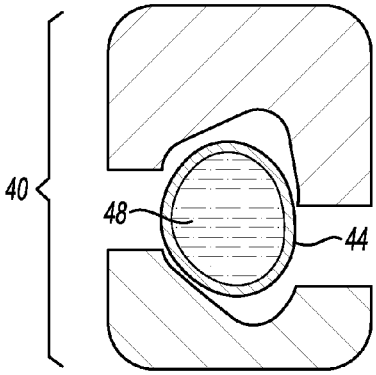
FIG. 6 is a diagrammatic cross-sectional view of the tube filled with a liquid in a hydro-forming die under a first level of pressure.

Referring to FIGS. 1 and 6, the next step in the process is to fill the tube in a hydro-forming die 40 with a liquid under a first level of pressure. The first level of pressure is within the range of 50 to 200 bar with a nominal pressure being 100 bar. This is illustrated in FIG. 6 in which the pre-bent/pre-formed tube 44 is filled with a hydro-forming liquid 48, such as water. The pre-bent/pre-formed tube 44 is shown to be more compressed in FIG. 6 in comparison to its condition in FIG. 5.

Figure 7:
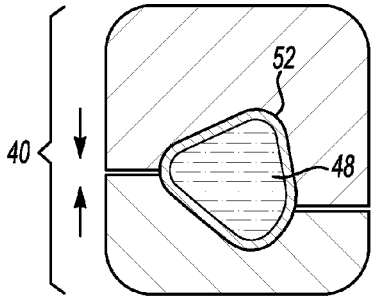
FIG. 7 is a diagrammatic cross-sectional view of the hydro-forming die being completely closed over the pre-bent/pre-formed tube under a second level, or calibration level of pressure.
Figure 8:
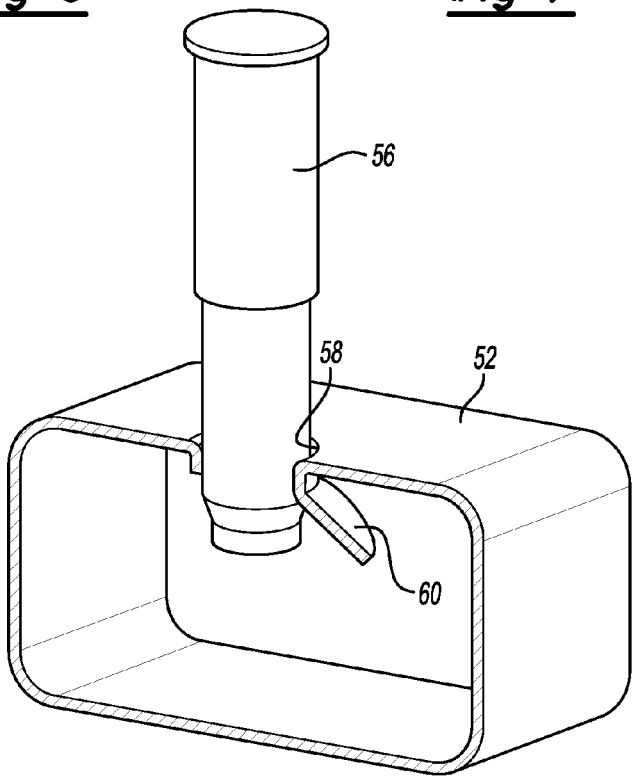
FIG. 8 is a partial cross-section view of a tube that is being hydro-pierced with a hydro-piercing punch.

Referring to FIGS. 1, 7 and 8, the next step in the process is to completely close the hydro-forming die at 50. Referring to FIG. 7, the hydro-forming die 40 is shown completely closed with the fully formed part 52 conforming to the die and with the liquid 48 filling the fully formed part 52. Referring back to FIG. 1, the process continues by increasing the level of pressure of the liquid to a second level to form and hydro-pierce the part at 54. The second level of pressure is within the range of 750 to 2,000 bar with a nominal pressure of 1,000 bar.

Referring to FIG. 8, the fluid formed part 52 is shown in isolation with a hydro-formed punch 56. The hydro-formed punch 56 may be incorporated as part of the hydro-formed die 40 to punch a hole 58 in the part 52 during the hydro-forming process in the hydro-forming die 40. A slug 70 is partially separated from the part 52 when the hole 58 is formed.

Referring to FIG. 1, the part may be trimmed at 64 and, as indicated, the trimming operation may be a laser trimming operation. It should be understood that other types of trimming operations may be used instead of laser trimming. Following the laser trimming operation, the part may be heat treated to artificially age the aluminum alloy at 66. The part may then be subjected to batch pretreatment, preferably with a plurality of other parts, to apply a conversion coating at 68.

Pressure sequence hydro-forming may be used to form a straight, longitudinally pre-bent and/or transversely pre-formed tube blank 36. The pre-bent/pre-formed tube 44 is placed in the hydro-forming die 40 and is filled with the hydro-forming liquid 48, or water, at a low pressure that may be referred to as the closing pressure before the hydro-forming die 40 is completely closed. As the hydro-forming die 40 closes, calibration pressure is gradually increased to shape the tube in the hydro-forming die 40. The corners of the part are primarily formed during die closing and the tubular blank retains the nominal wall thickness to enable forming materials having lower formability and assure maintaining the structural integrity of the tube 36.

The internal pressure within the tube resists the tendency of the tube to collapse that otherwise may occur upon closing the hydro-forming die 40. The closing fluid pressure in the tube is always greater than zero. The calibration pressure is used to shape the tube 36 and allows the use of lower tonnage presses and results in lower capital costs. In addition, pressure sequence hydro-forming makes it possible to form complex parts having greater structural integrity with improved accuracy.

The pressure sequence hydro-forming process when applied to an extruded structural tube should be performed to minimize expansion. Pressure sequence hydro-forming assures the structural integrity of the part even though the aluminum tubular blank has lower formability than that of steel.

While exemplary embodiments are described above, it is not intended that these embodiments describe all possible forms of the disclosed apparatus and method. Rather, the words used in the specification are words of description rather than limitation, and it is understood that various changes may be made without departing from the spirit and scope of the disclosure as claimed. The features of various implementing embodiments may be combined to form further embodiments of the disclosed concepts.

What is claimed is:

1. A method of forming a part comprising:

extruding an aluminum alloy to form an extruded structural tube by extruding heated aluminum through an extrusion die including a mandrel plate that separates the heated aluminum and a cap section that re-converges the heated aluminum to form the extruded structural tube with a plurality of weld lines being formed where the heated aluminum re-converges;

bending the tube longitudinally in a bending operation;

pre-forming the tube laterally in a pre-form die;

loading the tube into a hydro-forming die;

partially closing the hydro-forming die to radially compress the tube;

filling the tube with a liquid at a first level of pressure;

closing the hydro-forming die to radially compress the tube; and increasing the level of pressure applied to the liquid to a second level of pressure to shape the tube to form the part.

2. The method of claim 1 wherein the extrusion die is a porthole die.

3. The method of claim 1 wherein the first level of pressure is a closing pressure and the second level of pressure is a calibration pressure.

4. The method of claim 1 wherein the step of increasing the level of pressure within the tube in the hydro-forming die results in the tube being hydro-formed into the die.

5. The method of claim 4 wherein the step of increasing the level of pressure within the tube in the hydro-forming die further comprises hydro-piercing the tube.

6. A method of forming a part comprising:

extruding an aluminum alloy to form an extruded structural tube;

bending the tube longitudinally in a bending operation;

pre-forming the tube laterally in a pre-form die;

loading the tube into a hydro-forming die;

partially closing the hydro-forming die to radially compress the tube;

filling the tube with a liquid at a first level of pressure;

closing the hydro-forming die to radially compress the tube;

increasing the level of pressure applied to the liquid to a second level of pressure to shape the tube to form the part; and pre-bending the extruded structural tube in a rotary draw bending tool before the loading step.

7. A method of forming a part comprising:

extruding an aluminum alloy to form an extruded structural tube;

bending the tube longitudinally in a bending operation;

pre-forming the tube laterally in a pre-form die;

loading the tube into a hydro-forming die;

partially closing the hydro-forming die to radially compress the tube;

filling the tube with a liquid at a first level of pressure;

closing the hydro-forming die to radially compress the tube;

increasing the level of pressure applied to the liquid to a second level of pressure to shape the tube to form the part; and heating the part after forming to artificially age the aluminum alloy.

8. A method of forming a part comprising:

extruding an aluminum alloy through a porthole die to form an extruded structural tube;

cutting the tube;

pre-bending the tube to form a pre-bent tube;

loading the pre-bent tube into a pre-forming die;

closing the pre-forming die partially to radially compress the pre-bent tube to form a pre-bent/pre-formed tube;

filling the pre-bent/pre-formed tube with a liquid that is under a first level of pressure;

closing the hydro-forming die completely; and increasing the level of pressure applied to the liquid to a second level of pressure that is greater than the first level of pressure to shape the pre-bent/pre-formed tube.

9. The method of claim 8 wherein the extruding step further comprises extruding heated aluminum through an extrusion die including a mandrel plate that separates the heated aluminum and a cap section that re-converges the heated aluminum to form the extruded structural tube with a plurality of weld lines being formed where the heated aluminum re-converges.

10. The method of claim 8 wherein the step of pre-bending the pre-bent/pre-formed tube is performed in a bending tool before the loading step.

11. The method of claim 8 wherein the step of increasing the level of pressure further comprises increasing the level of pressure beginning with the step of filling the pre-bent tube and wherein the level of pressure is gradually increased to the second level.

12. The method of claim 8 wherein the step of increasing the level of pressure with the pre-bent/pre-formed tube in the hydro-forming die results in hydro-forming the pre-bent/pre-formed tube into the hydro-forming die.

13. The method of claim 12 wherein the step of increasing the level of pressure within the pre-bent/pre-formed tube in the hydro-forming die further comprises hydro-piercing the tube.

14. The method of claim 8 further comprising heating the part after forming to artificially age the aluminum alloy.

* * * * *